US005553653A

United States Patent [19]

Rozon

[11] Patent Number: 5,553,653

[45] Date of Patent: Sep. 10, 1996

[54] CORD RETRACTOR FOR WINDOW BLINDS

[75] Inventor: David Rozon, Russell, Canada

[73] Assignee: 2844788 Canada Ltee, Hull, Canada

[21] Appl. No.: 262,575

[22] Filed: Jun. 20, 1994

[51] Int. Cl.[6] ..... F06B 9/30

[52] U.S. Cl. ..... 160/173; 160/178.1; 74/502

[58] Field of Search ..... 160/168.1 R, 168.1 V, 160/177 V, 177 R, 176.1 R, 176.1 V, 178.1 R, 178.1 V, 178.2 R, 173 R, 216, 217, 219; 254/385, 386; 74/502

[56] References Cited

U.S. PATENT DOCUMENTS

| | | | |
|---|---|---|---|
| 2,116,357 | 5/1938 | Laborda et al. | 160/168.1 R |
| 5,038,843 | 8/1991 | Sommerfeld | 160/168.1 VX |
| 5,092,383 | 3/1992 | Niemeijer et al. | 160/168.1 R X |

FOREIGN PATENT DOCUMENTS

| | | | |
|---|---|---|---|
| 16458 | 7/1898 | United Kingdom | 160/320 |

*Primary Examiner*—Blair M. Johnson
*Attorney, Agent, or Firm*—Adrian Zahl

[57] ABSTRACT

A cord retractor is provided to take up the dangling cords of a window blind. The retractor comprises a sliding cord engagement member housed within a hollow wand. The wand has an axial slot extending the length of its sidewall. A handle outside the wand is linked to the engagement member by an arm connecting the respective members and extending through the slot. A cord fastening means fixedly engages an end of the window blind cord to the wand. The sliding engagement member retracts a loop of cord into the interior of the wand when the handle is displaced downwardly along the wand to retract the cord into the wand. The wand may be removably engaged to the head rail of a window blind when not in use by means of a hook.

7 Claims, 4 Drawing Sheets

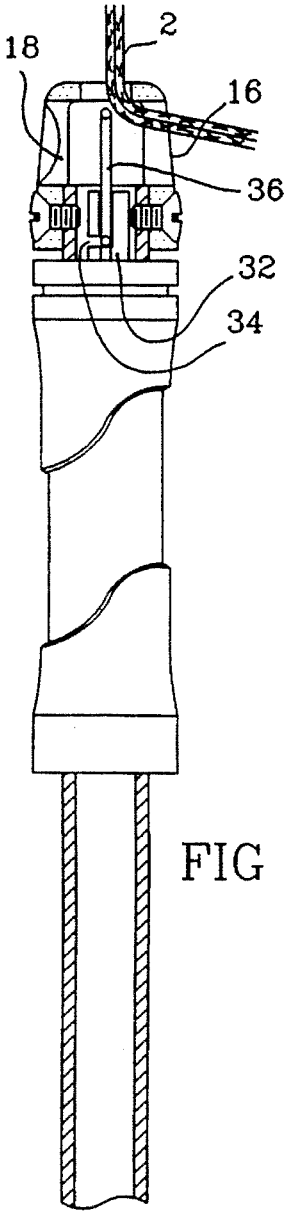
FIG 5
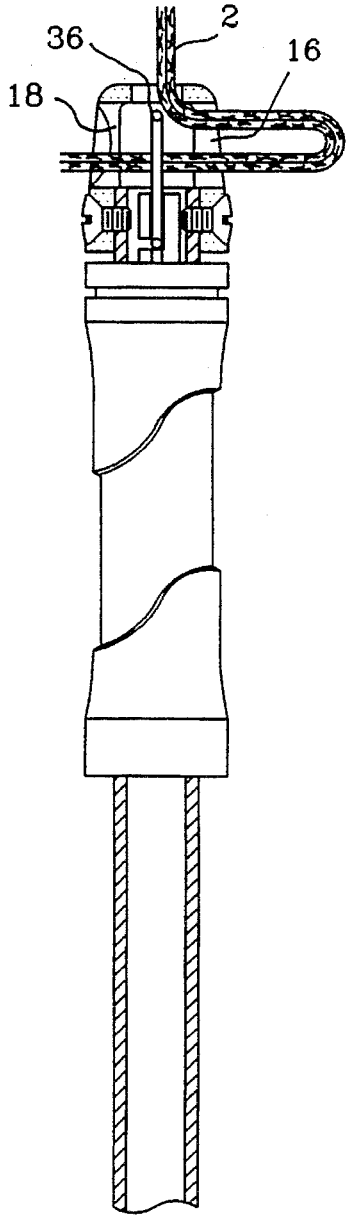
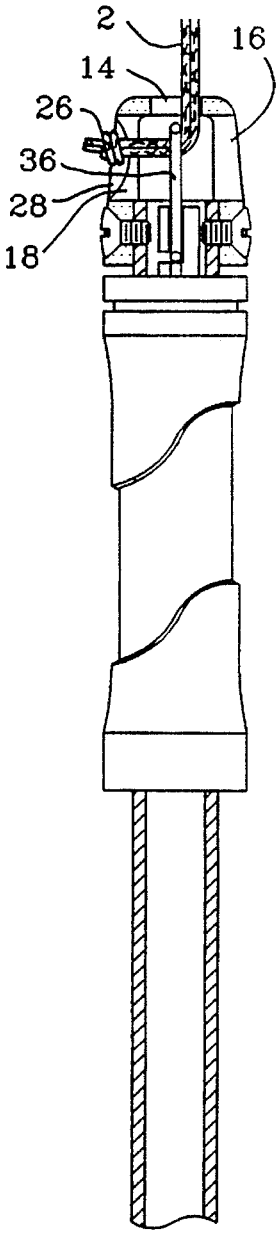
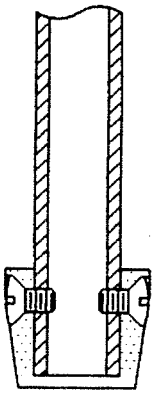
FIG 6
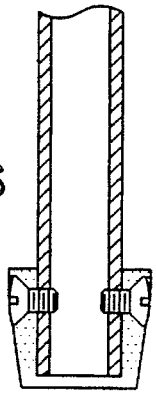
FIG 7
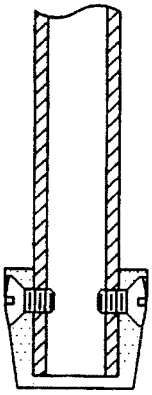

CORD RETRACTOR FOR WINDOW BLINDS

FIELD OF THE INVENTION

The present invention relates to a cord retractor for taking up the dangling cord of a window blind, and in particular, the cord of a venetian blind having horizontal slats.

BACKGROUND OF THE INVENTION

The dangling cords of window blinds present a significant safety hazard around young children. In recent years, a number of strangulation deaths have occurred when young children have become entangled in cords dangling from window blinds. Window blinds, and in particular horizontal slat venetian blinds, are typically provided with dangling cords that may in some cases reach the floor. A venetian blind is typically provided with two or four slat-elevating cords (that may comprise one or more loops or free-ended cord knotted or otherwise joined at their ends) that are drawn downwardly to elevate the slats. The cords are drawn downwardly by the same distance as the slats are elevated. As a result, when the slats are fully elevated, the cords may dangle a considerable extent.

Various solutions have been proposed to address this problem. For example, U.S. Pat. No. 5,279,473 (Rozon) and co-pending application Ser. No. 08/022,891 represent solutions devised by the present inventor to take up window blind cords with a spring-driven spool device.

Any such device faces several requirements. First and foremost, it must effectively retract the cords out of harm's way and be simple to operate and install. Second, in order to present a pleasing appearance, it must be relatively compact. Third, it must be simple, in order to reduce costs.

OBJECTS OF THE INVENTION

The present invention has as its objects the provision of a cord retractor adapted for use with window blind cords that is simple to manufacture, easy to use and install, and is capable of being housed within a compact and attractive wand.

SUMMARY OF THE INVENTION

The present device addresses these requirements and objects by providing a wand-shaped cord retractor for use with free-ended window blind cords. While the present device is specifically intended for use with horizontal slat venetian blinds, it may be used with the cords of other types of window coverings. The device is adapted to be engaged to a window blind cord, and is provided with a sliding cord engagement member housed within a wand, to retract a portion of the cord into the wand. For most applications, the device will be adapted to retract either two or four cords. In its most general form, the present invention comprises the following elements:

a) an elongate, generally hollow retractor body, which may be tubular, having an axial slot through the wall of the body extending generally the length thereof and communicating between the exterior and interior of the body;

b) a cord fastening means adapted to fixedly engage the free end of an end of window blind cord to the retractor body;

c) a sliding engagement member to slideably engage a loop of the cord and retract the cord into the body. The sliding engagement member may comprise a wire loop extending upwardly from a body slideably disposed within the interior of the retractor body, displaceable between upper and lower ends of the retractor body. The sliding engagement member is adapted to slideably engage the cord and draw a loop of the cord into the retractor body when displaced axially within the body, with the loop comprising at least first and second strands which are longitudinally displaced in opposing directions by longitudinal displacement of the engagement member, with the loop being consequently lengthened as it is drawn into the retractor body by the engagement member;

d) a handle, integral with the sliding engagement member and external to the retractor body. The handle is linked to the sliding engagement member by a connecting member that extends through the slot. Linear displacement of the handle along the retractor body causes the sliding engagement member to be axially displaced within the body and to draw a loop of cord into the retractor body.

The wand may be removably engaged to the head rail of a window blind by means of a hook.

The device is intended to retract surplus cord after the user has operated the blind cord to raise or lower the blind.

In a preferred embodiment of the device, the upper end of the retractor body is capped by an end cap, having first, second and third apertures extending through its wall. The first aperture permits the cord to enter the retractor body. The second aperture provides user access to the interior of the cap for access to the fixed and sliding cord engagement members, and the third aperture comprises the cord fastening means by retaining a knotted end of the cord. The handle may comprise a tubular member encircling the retractor body, having an arm extending radially inwardly from the member through the slot and engaged to the sliding cord engagement member.

It will be understood that although the term "tubular" may be employed to describe the shape of the retractor body, the body may comprise any elongate hollow member, including a body having a rectangular or other multi-faceted cross section. The directional references used herein refer to the device positioned in its normal in-use position, with the retractor body being oriented generally vertically and the upper end cap at the upper end of the retractor body.

BRIEF DESCRIPTION OF THE DRAWINGS

FIG. 5 is a side elevational view as in FIG. 2, showing the cord in a first step of assembly to the device;

FIG. 6 is a side elevational view as in FIG. 2, showing the cord in a second stage of assembly to the device;

FIG. 7 is a side elevational view as in FIG. 2, showing the cord in a third stage of assembly to the device;

DETAILED DESCRIPTION OF THE PREFERRED EMBODIMENT

Figure 1:
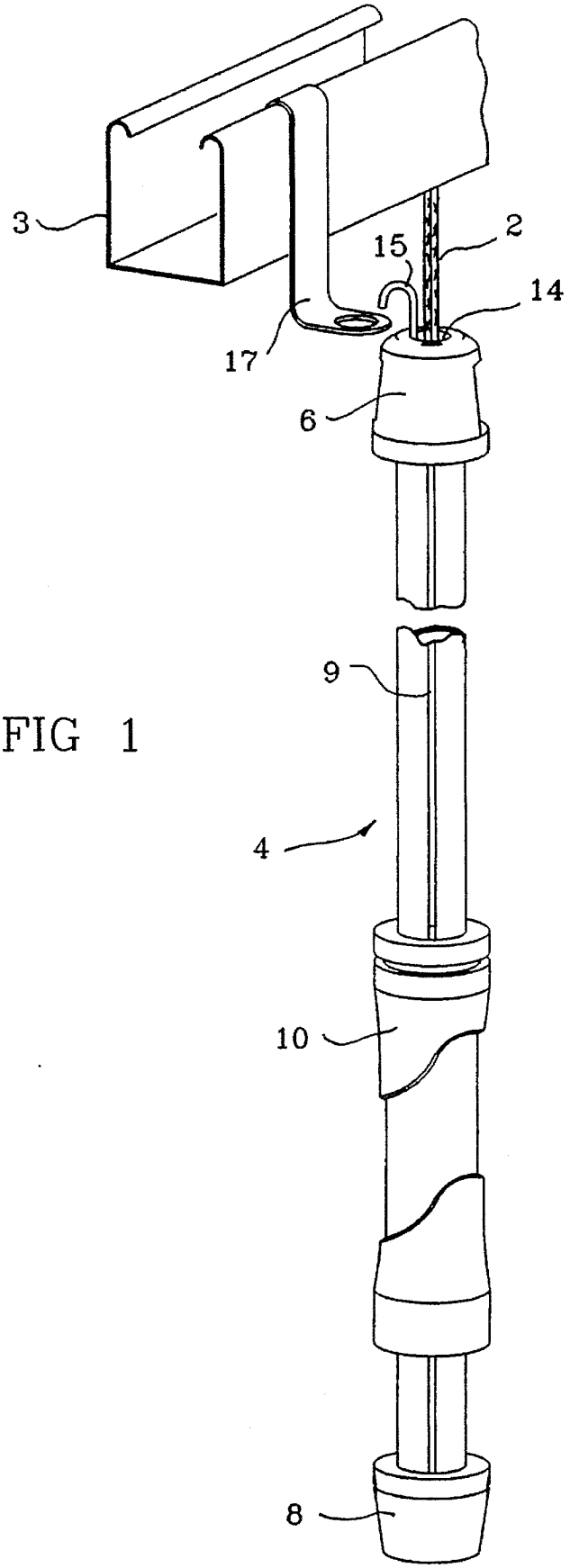
FIG. 1 is a perspective view of the device and a headrail and cord of a window blind.
Figure 2:
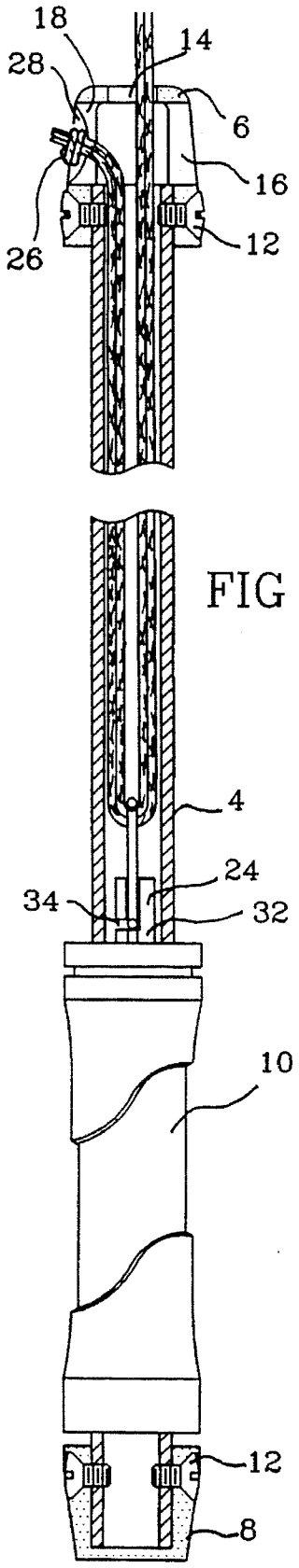
FIG. 2 is a side elevational view, partly in section, showing the cord drawn into the body of the device.

Referring to FIGS. 1 and 2, the present invention comprises a wand adapted to be engaged to a cord 2 of a horizontal slat window blind. Typically, the cord will comprise the dual elevation cords of a venetian blind. Although the device is shown in use with a dual cord, it may be equally used with other numbers of cords. The cords typically depend from the headrail 3 of a venetian blind and comprise the slat elevation cords of the blind. The device is provided with an elongate tubular retractor body 4, capped by hollow upper and lower end caps 6 and 8. An elongate axial slot 9 extends generally the length of the retractor body and communicates with the interior of the body. The width of the slot 9 may be less than the thickness of a typical window blind cord, in order to prevent binding of the cord within the slot. The end caps each have a generally truncated conical shape, and are fastened to the retractor body by way of a pair of screws 12. For structural purposes, the screws 12 are positioned on an axis offset by 90 degrees from the slot 9. A generally tubular handle 10 encircles the retractor body, and is slideably displaceable between the upper and lower ends of the body. The end caps 6 and 8 serve as stops to prevent the handle from disengaging from the retractor body.

Figure 3:
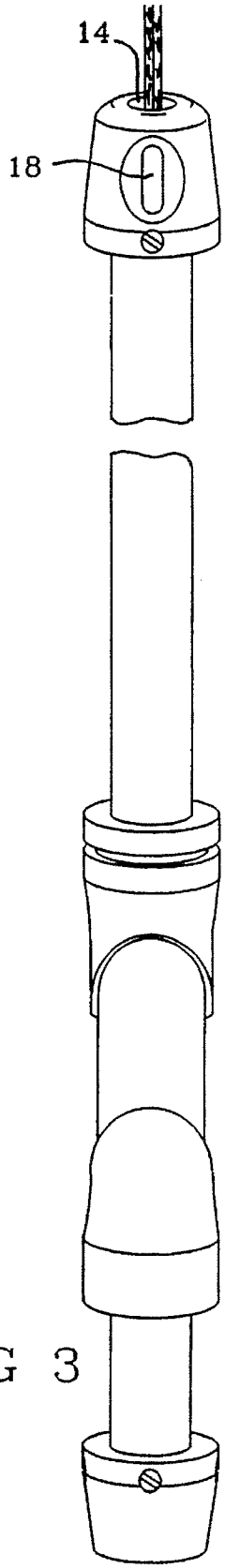
FIG. 3 is a perspective view of the device.
Figure 4:
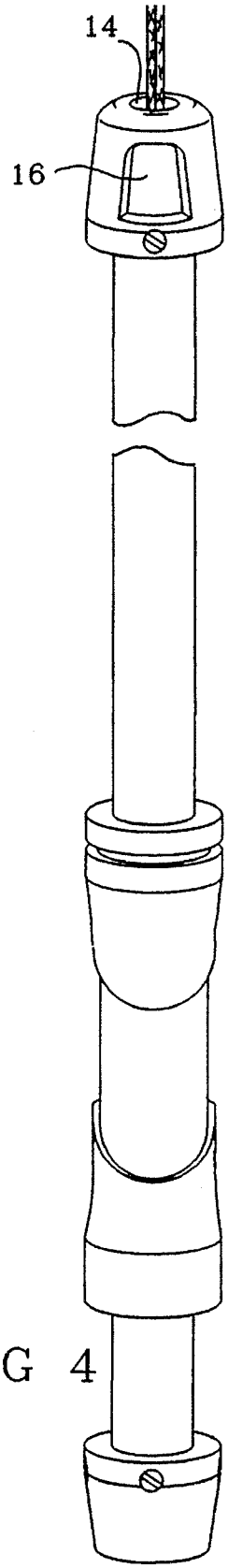
FIG. 4 is a perspective view, illustrating an opposing side from FIG. 3.

Referring to FIGS. 3 and 4, the upper cap 6 is provided with first, second and third apertures 14, 16 and 18, respectively. The first aperture 14 extends through the top of the cap and comprises a cord entry to enable the cord to enter the device. The second aperture 16 extends through the sidewall of the cap and provides user access to the interior of the cap 6 to allow a user to thread the cord through the device, as will be described below. The third aperture 18 opposes the second aperture and comprises a fixed cord fastening means, as will be described below.

An inverted hook 15, seen in FIG. 1, extends upwardly from the upper face of the upper end cap 6, and mates with a hanger 17 extending downwardly from the head rail 3, to permit a user to hang the device from the head rail when the device is not is use.

Referring to FIG. 2, the cord 2 enters the interior of the device through the first aperture 14 and descends vertically through the interior of the retractor body 4. A sliding engagement member 24 is slideably disposed within the interior of the body, and slideably engages a loop of the cord 2. The cord passes through the wire loop 36 of the sliding engagement member, described below, and the end of the cord extends through the third aperture 18 to exit the device. A knot 26 tied at the end of the cord prevents the cord from slipping back through the third aperture, and fixedly engages the cord to the device. The knot and third aperture comprise the cord fastening means. A recess 28 within the sidewall of the cap may be provided at the aperture 16 to provide a flush appearance when the knot is pulled against the rim of the third aperture.

Figure 8:
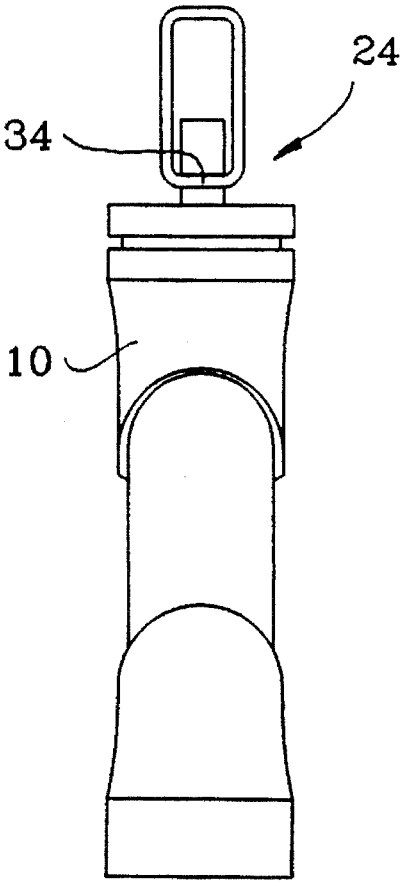
FIG. 8 is a side elevational view of the handle and sliding cord engagement portion of the device.
Figure 9:
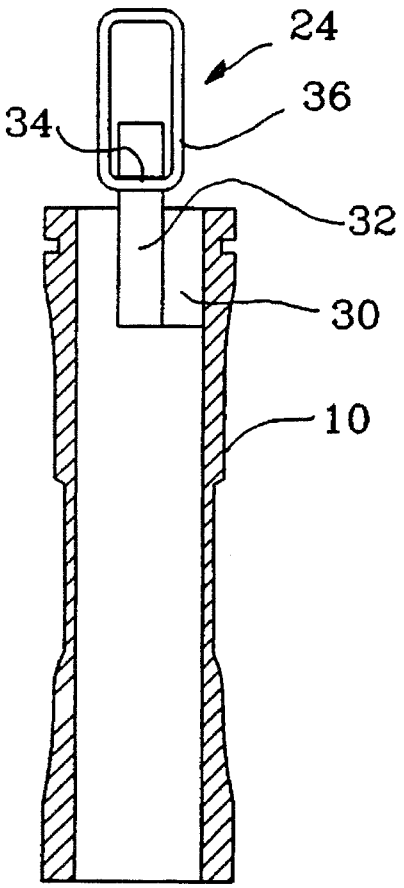
FIG. 9 is a side sectional view of the handle and ; sliding cord engagement portion of the device.

The sliding engagement member 24, seen more particularly in FIGS. 8 and 9, is engaged to the handle 10 by means of an arm 30 that extends radially inwardly from the interior wall of the handle, through the slot 9. Thus, vertical displacement of the handle displaces the sliding engagement member vertically within the body. The sliding engagement member comprises a body 32, having a horizontally-oriented slot 34 at its upper end. A wire loop 36 is snap-fitted into the slot, and extends upwardly from the body. The cord 2 extends through the loop 36, which when displaced downwardly, as seen in FIG. 2, draws a loop of cord downwardly into the interior of the body 4. The plane of the loop is offset by 90 degrees from the slot 9, in order to position the cord away from the slot when the cord is drawn downwardly within the body. The loop 36 has a width slightly less than the interior diameter of the body, and is prevented from slipping out of the slot 34 by contact with the interior wall of the body.

Assembly of the device to a cord will now be described by reference to FIGS. 5, 6 and 7. The initial step requires the user to insert tire cords into the cap through the first aperture 14 and out the second aperture 16, as seen in FIG. 5, with the handle being positioned at its uppermost position. The user then inserts the cords back into the second aperture, radially through the upper cap and the wire loop 36, and out the third aperture 18, as seen in FIG. 6. At this stage, the user will ensure that the blind cords are evenly tensioned, and that the blind slats are horizontal. The user then draws sufficient cord through the device to draw its upper end adjacent the head rail (when the blind cords are in their least extended position). The free ends of the cord are knotted together, as seen in FIG. 7, with the knot 26 resting within the recess 28. If it is required to adjust the relative positions of the cord to adjust the slat positions, this may be accomplished by untying the knot 26 and readjusting the cord prior to retying the knot. The user then trims any surplus cord that extends from the device.

Operation of the device is effected by removing the device from the hanger 17 and drawing the handle 10 either upwardly or downwardly, depending on whether it is desired to release cord from the device or draw it into the device. If the cord is excessively long, it may also be necessary to pull the whole device downwardly. After use, the device is replaced on the hanger.

Although the present invention has been described by way of a preferred embodiment, it will be seen those skilled in the art that variations and departures from the invention described herein may be made within departing from the spirit and scope of the invention, as defined in the appended claims.

I claim:

1. A cord retractor for attachment to a window blind cord for the taking up of said cord, said cord having a free end, said cord retractor comprising:

a) an elongate, generally hollow retractor body having an axial slot through the wall thereof extending generally the length thereof and communicating between the interior and exterior of the retractor body, said retractor body having upper and lower ends;

b) cord fastening means fixedly engaging said free end of said cord to one of said ends of said retractor body;

c) a sliding engagement member slideably disposed within said retractor body and longitudinally displaceable between said upper and lower ends of said retractor body, said sliding engagement member slideably engaging said cord and drawing a loop comprising at least first and second strands of said cord into said retractor body and longitudinally displacing said first and second strands in opposing directions from each other to cooperate with said cord fastening means to lengthen said loop as said loop is drawn into said retractor body by the longitudinal displacement of said engagement member; and d) a handle external to said retractor body and connected to said sliding engagement member through said slot to permit said sliding engagement member to be axially displaced within said retractor body by the axial sliding movement of said handle along said retractor body.

2. A cord retractor as claimed in claim 1, wherein said cord fastening means is adapted to fixedly engage an end of said cord to the upper end of said retractor body.

3. A cord retractor as claimed in claim 1, wherein said sliding engagement member comprises a wire loop extending upwardly from a slideable body, said slideable body slideably disposed within the interior of said retractor body, said wire loop being adapted to slideably engage said cord.

4. A cord retractor as claimed in claim 1, wherein said handle and said sliding engagement member comprise a unitary member and are linked together by means of a rigid connecting member extending through said slot.

5. A cord retractor as claimed in claim 4, wherein said handle comprises a generally tubular member encircling and slideably engaged to said retractor body, having an arm extending radially inwardly from said member through said slot and engaged to said sliding engagement member.

6. A cord retractor as claimed in claim 1 wherein said cord fastening means comprises a cap engaged to said upper end of said retractor body, said cap having a passage therethrough communicating with the interior of said retractor body to receive said cord and fixedly engage a knot within said cord.

7. A cord retractor as claimed in claim 6, wherein said cap is further provided with an access aperture communicating with said passage, to permit a user to thread said cord through said passage.

* * * * *